United States Patent [19]

Frazzini

[11] 4,080,746

[45] Mar. 28, 1978

[54] LOADER BUCKET ASSEMBLY FOR EARTH WORKING EQUIPMENT

[75] Inventor: Thomas G. Frazzini, Export, Pa.

[73] Assignee: Asbury Industries, Inc., Pittsburgh, Pa.

[21] Appl. No.: 778,366

[22] Filed: Mar. 17, 1977

[51] Int. Cl.[2] ..... E02F 3/76

[52] U.S. Cl. ..... 37/117.5; 214/146 R; 214/78; 214/132

[58] Field of Search ..... 37/103, 117.5, 118; 214/145 R, 146 R, 768, 131, 132, 78

[56] References Cited

U.S. PATENT DOCUMENTS

| | | | |
|---|---|---|---|
| 2,795,342 | 6/1957 | Steele | 214/132 X |
| 3,002,638 | 10/1961 | Needy | 214/132 |
| 3,268,101 | 8/1966 | Pensa | 37/117.5 X |
| 3,348,715 | 10/1967 | Kretz | 214/145 X |
| 3,503,144 | 3/1970 | Stewart | 37/117.5 |
| 3,869,054 | 3/1975 | Moreau | 37/118 X |
| 3,966,066 | 6/1976 | Schexnayder | 214/146 R |

FOREIGN PATENT DOCUMENTS

| | | | |
|---|---|---|---|
| 211,535 | 3/1957 | Australia | 214/146 R |
| 919,219 | 2/1963 | United Kingdom | 37/117.5 |
| 1,423,377 | 2/1976 | United Kingdom | 37/117.5 |

*Primary Examiner*—E. H. Eickholt

*Attorney, Agent, or Firm*—Stanley J. Price, Jr.; John M. Adams

[57] ABSTRACT

A carrier portion is connected by tilt cylinders and lift booms to the front end of a conventional earth working machine. A bucket portion for loading, carrying and discharging materials is positioned between a pair of forwardly extending arm members of the carrier portion. Sidewalls of the bucket portion are positioned adjacent the arm members and include a pivot arm assembly for pivotally connecting the bucket portion to the arm members. A pair of piston cylinder assemblies are connected to the carrier portion and to the upper end of the pivot arm assembly. Actuation of the piston cylinder assemblies pivots the bucket portion on the carrier arms to move the bucket portion in an arcuate path toward and away from the carrier portion. When the loader bucket assembly is raised by the lift booms to the maximum vertical height for discharging the contents of the bucket portion, a hydraulic control system actuates the tilt cylinders to first pivot the carrier portion together with the bucket portion forwardly. Thereafter, the bucket portion is automatically pivoted forwardly relative to the carrier portion to complete the discharging operation.

10 Claims, 5 Drawing Figures

LOADER BUCKET ASSEMBLY FOR EARTH WORKING EQUIPMENT

BACKGROUND OF THE INVENTION

1. Field of the Invention

This invention relates to materials handling apparatus adaptable for mounting on a conventional earth working machine and more particularly to a loader bucket assembly that includes a carrier portion pivotally mounted on the boom of the earth working machine and a bucket portion pivotally connected to the carrier portion and operable through a control system to automatically carry out the discharging cycle of the loader bucket assembly.

2. Description of the Prior Art

Conventional bucket type loaders or excavating buckets generally include a bucket portion defined by a horizontal bottom wall with a transverse cutting edge extending forwardly from the bottom wall. A rear wall extends upwardly in a curved arc from the rear of the bottom wall and terminates in an upper transverse edge spaced above the lower transverse cutting edge. Laterally spaced vertical sidewalls are secured to and extend between the sides of the bottom and rear walls. Generally, with conventional loaders, a bucket portion is supported by a carrier portion that is rigidly secured to the bucket portion and includes a pair of forwardly extending parallel spaced arm members that are secured to and positioned laterally of the bucket sidewalls. The rearward portion of the arm members is pivotally connected to the forward end portion of lift booms of a tractor or earth working machine. The lift booms are pivotal through a vertical arcuate path about a pivotal axis on the tractor by operation of manually controlled piston cylinder assemblies. With this arrangement, the carrier portion, together with the bucket, is raised and lowered by the lift booms. Tilt cylinders extending from the lift booms of the tractor are forwardly connected to the rear wall of the bucket or to the frame of the carrier secured to the rear wall of the bucket. Operation of the tilt cylinders effects pivoting and/or tilting of the bucket relative to the front end of the lift booms and the tractor.

It is also known, with high lift bucket type loaders, to pivotally mount the bucket portion to the carrier portion. With this arrangement, it is customary procedure to first vertically raise the entire assembly to a preselected vertical height through one manual control. This followed by manual actuation of a second control to forwardly pivot or tilt the bucket and carrier portions combined. A third manual control is then actuated to effect pivoting or roll of the bucket portion on the carrier portion to completely discharge the contents of the bucket portion. The manual operation of these respective controls requires that the operator exercise his own judgment as to the completion of one cycle before another can be initiated. Once the bucket portion is loaded actuation of the first control raises lift booms to move the bucket to a maximum vertical height at which it is to be discharged. When this step is completed tilt cylinders are actuated by manually operating a second control lever to forwardly pivot the bucket portion on the carrier portion and move the bucket portion to a first discharging position. The third operation is commenced when the operator has determined that the carrier portion has been fully pivoted. This is difficult to determine, particularly when the bucket is raised to the maximum vertical height for high lift operations. With some arrangements an indicator alerts the operator as to the completion of the carrier tilt so that he may initiate the bucket roll. The bucket roll on the carrier is commenced by operating a third control lever; however, the carrier tilt must be completed before the third control lever is actuated.

It is known with loaders, particularly with side dump loaders as disclosed in U.S. Pat. No. 3,207,342, to provide hydraulic cylinders that operate sequentially to complete the side dumping operation. With this arrangement, a loading bucket is retained in a predumping position on a carrier or frame by a latch. The loaded bucket is raised by one lever to a vertical dumping position. Then, in sequential order, a pair of cylinders is operated to first provide for operation of the latching mechanism to fully release the bucket from its predumping position. Upon release, actuation of the second cylinder operates the side dumping mechanism to pivot the bucket to a dumping position. Hydraulic fluid is supplied to both cylinders simultaneously by the same operating valve.

There is need to provide a loader bucket assembly that is readily adaptable for installation on conventional earth working machines to increase the capacity of the machine without an accompanying loss in vertical dump height and machine stability. The loader bucket must be easily mounted on the earth working machine to facilitate the conversion on the machine from a smaller bucket assembly to an enlarged bucket assembly. The combination of the loader bucket and earth working machine should be efficiently operated by reducing the number of controls which the operator must maneuver and monitor in order to carry out a complete cycle of operation from loading, hauling to discharging. This should be accomplished by a control system that is economically and efficiently operated.

SUMMARY OF THE INVENTION

In accordance with the present invention there is provided a loader bucket assembly for an earth working machine that includes a bucket portion having a back plate engaged to a pair of spaced parallel sidewalls and a floor plate to form an open forward end portion for receiving and discharging materials. A carrier portion is positioned rearwardly of the bucket portion and has a pair of spaced parallel arm members positioned outboard of the bucket sidewalls. A pivot assembly is secured to the bucket sidewalls for connecting the carrier arm members to the bucket sidewalls. This arrangement permits pivotal movement of the bucket portion through an arcuate path toward and away from the carrier portion. A first actuator mechanism is connected to the carrier portion for forwardly pivoting the carrier portion and the bucket portion to a first position for discharging the contents of the bucket portion. A second actuator mechanism is mounted on the carrier portion and is connected to the pivot assembly for moving the bucket portion from the first position to a second position relative to the carrier portion. A control system actuates the first actuator mechanism to pivotally move the carrier portion and the bucket portion to the first position. Thereafter, the control system is operable to automatically actuate the second actuator mechanism after actuation of the first actuator mechanism to forwardly pivot the bucket portion on the carrier portion to complete the discharge of the contents of the bucket portion.

The arm members of the carrier portion extend laterally of the bucket portion and include at the rearward end portion vertically extending portions. The extending portions are connected at the top and bottom thereof by horizontally extending beam members. Horizontal beam members are connected to the arm members and a pair of brackets extend rearwardly from the beam members. The upper end portion of the brackets are arranged to contact the upper portion of the bucket back plate to support the bucket portion in a hauling position. The brackets are adapted for connection to the lift boom of a conventional earth working machine. With this arrangement, the carrier portion is raised and lowered by the lift booms to position the bucket portion at a preselected vertical height above ground.

The first actuator mechanism is connected at one end to the bracket pairs and at the opposite end through a conventional linkage to the lift booms of the earth working machine. Thus, when the loader bucket assembly is raised to a preselected vertical height by the lift booms, operation of the first actuator mechanism forwardly pivots the carrier portion on the lift booms to move the bucket portion to an initial position for discharging the contents of the bucket portion. This movement is sequentially followed, upon actuation of the second actuator mechanism, by forward pivoting of the bucket portion on the carrier portion. The two operations are carried out by a single actuation of the control system.

A hydraulic control system is provided for automatically carrying out the discharging operation of the loader bucket. The control system includes a control valve that directs the flow of pressurized fluid to and from the piston cylinder assemblies that comprise the first and second actuator mechanisms. With the loader bucket assembly raised by the machine lift booms to a preselected discharging height, actuation of the control valve, in turn, actuates a spool valve through a solenoid valve to supply fluid to the first actuator mechanism to initially pivot the carrier portion together with the bucket portion forwardly on the boom members. Sequentially thereafter, the second actuator mechanism is automatically actuated through an electrical control system associated with the solenoid valves of both actuator mechanisms. Once the carrier portion is forwardly pivoted, the bucket portion is forwardly pivoted on the carrier portion. Thus, the combined pivotal movement of the carrier portion and the bucket portion, automatically followed by the pivotal movement of the bucket portion relative to the carrier portion effects discharging of the contents of the bucket portion without requiring the operator to initiate the two pivotal movements by operation of two manual controls. Both operations are conducted by actuation of a single control of the control system of the present invention.

Accordingly, the principal object of the present invention is to provide a loader bucket assembly for an earth working machine that includes a combination carrier portion and bucket portion in which the bucket portion is pivotally mounted on the carrier portion to facilitate discharging of material from the bucket portion.

Another object of the present invention is to provide a combination bucket portion and carrier portion adaptable for mounting on a conventional earth working machine in which a control system is operable to first effect pivotal movement of both the carrier portion and the bucket portion, followed sequentially by pivotal movement of the bucket portion relative to the carrier portion to complete the discharging operation.

A further object of the present invention is to provide a loader bucket assembly for an earth working machine that includes a bucket portion pivotally connected to a carrier portion where the carrier portion is adapted for mounting on a conventional earth working machine to facilitate mounting an enlarged loader bucket assembly on a conventional earth working machine without encountering a reduction in the vertical dump height or stability of the machine.

An additional object of the present invention is to provide a control system for a loader bucket assembly which automatically carries out the discharging operation of the assembly without the need for operator control of each movement of the assembly or reliance upon an indicator as to when the various controls are to be operated.

These and other objects of the present invention will be more completely described and disclosed in the following specification, the accompanying drawings and the appended claims.

DESCRIPTION OF THE PREFERRED EMBODIMENT

Figure 1:
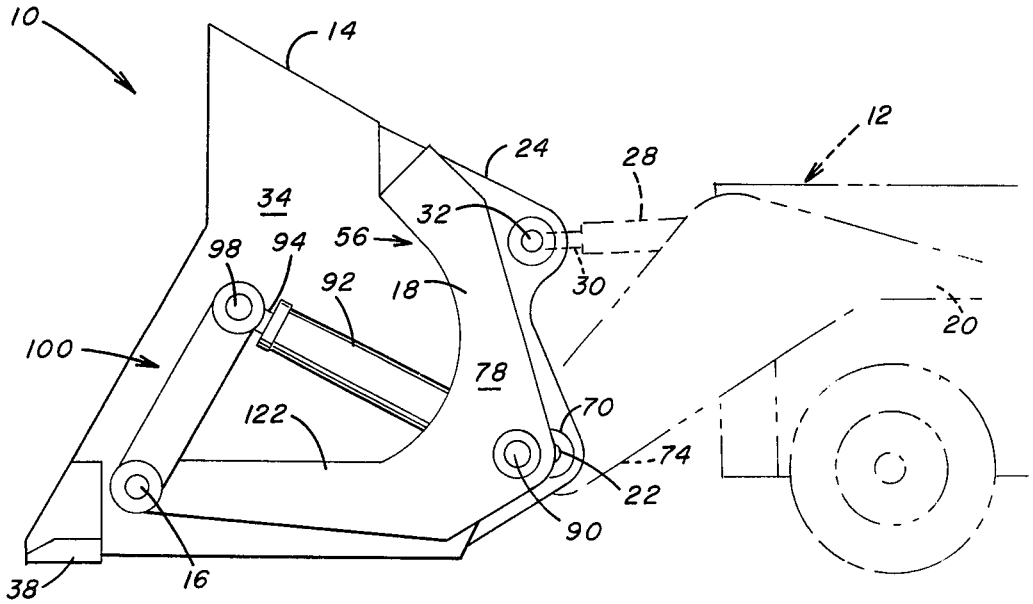
FIG. 1 is a schematic fragmentary, side elevation of the loader bucket assembly mounted on a conventional earth working machine.
Figure 2:
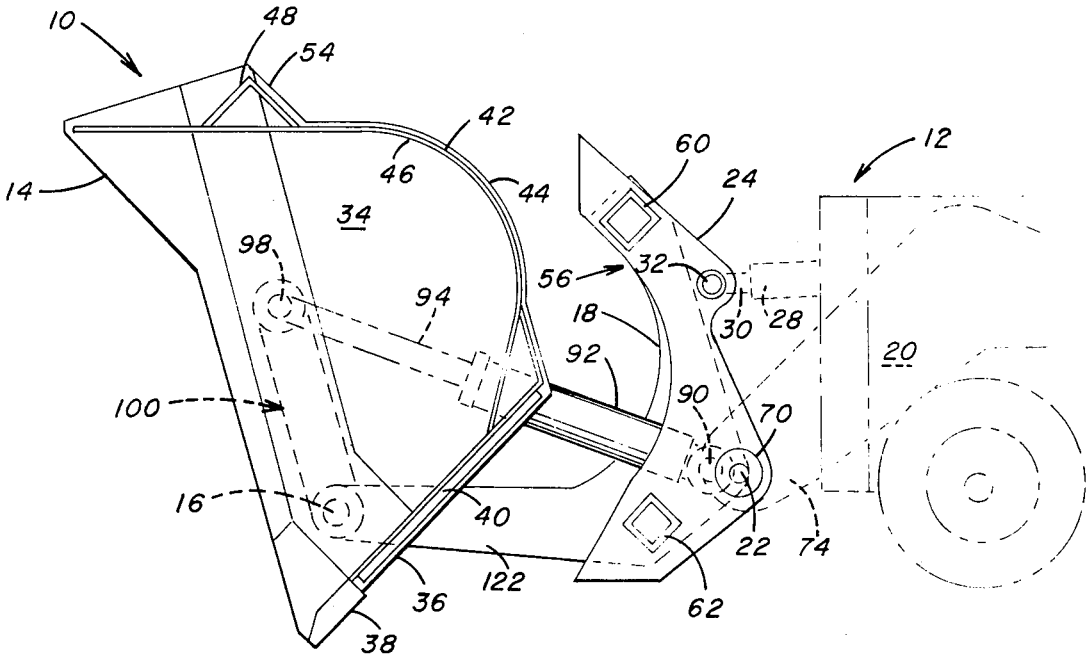
FIG. 2 is a schematic fragmentary, sectional side elevation of the loader bucket assembly, illustrating the bucket pivoted forwardly in a discharging position on a carrier assembly that supports the bucket and is secured to the earth working machine.

Referring to the drawings and particularly to FIGS. 1 and 2 there is illustrated a loader bucket assembly generally designated by the numeral 10 that is mounted to the front portion of a conventional earth working machine generally designated by the numeral 12 such as a tractor, crawler or wheeled type unit. The loader bucket assembly includes a bucket portion 14 that is pivotally connected by pins 16 to a carrier portion 18. The carrier portion 18 is mounted on the forward end of a pair of lift booms 20 by boom pins 22 which pivotally connect the lift booms 20 to a bracket assembly generally designated by the numeral 25 that includes a pair of parallel spaced brackets 24 and 26 that extend rearwardly from each side of the carrier portion 18 as illustrated in greater detail in FIG. 4. Piston cylinder assemblies (not shown) are operable to raise and lower the lift booms 20 together with the carrier portion 18 and thereby raise the bucket portion 14 to a preselected vertical height above ground.

A pair of tilt piston cylinder assemblies 28 are pivotally connected in a conventional manner at one end portion to the earth working machine 12 and include at the opposite end portion an extensible piston rod 30 that is connected by pins 32 to the upper portion of the parallel spaced brackets 24 and 26 on the carrier portion 18. Upon actuation of the piston cylinder assemblies 28 a tilting movement is imparted to the carrier portion 18 and therefrom to the bucket portion 14 for positioning the bucket portion 14 in the desired materials handling position, i.e., a hauling position for transporting material or in a discharging position for emptying the bucket portion.

Figure 3:
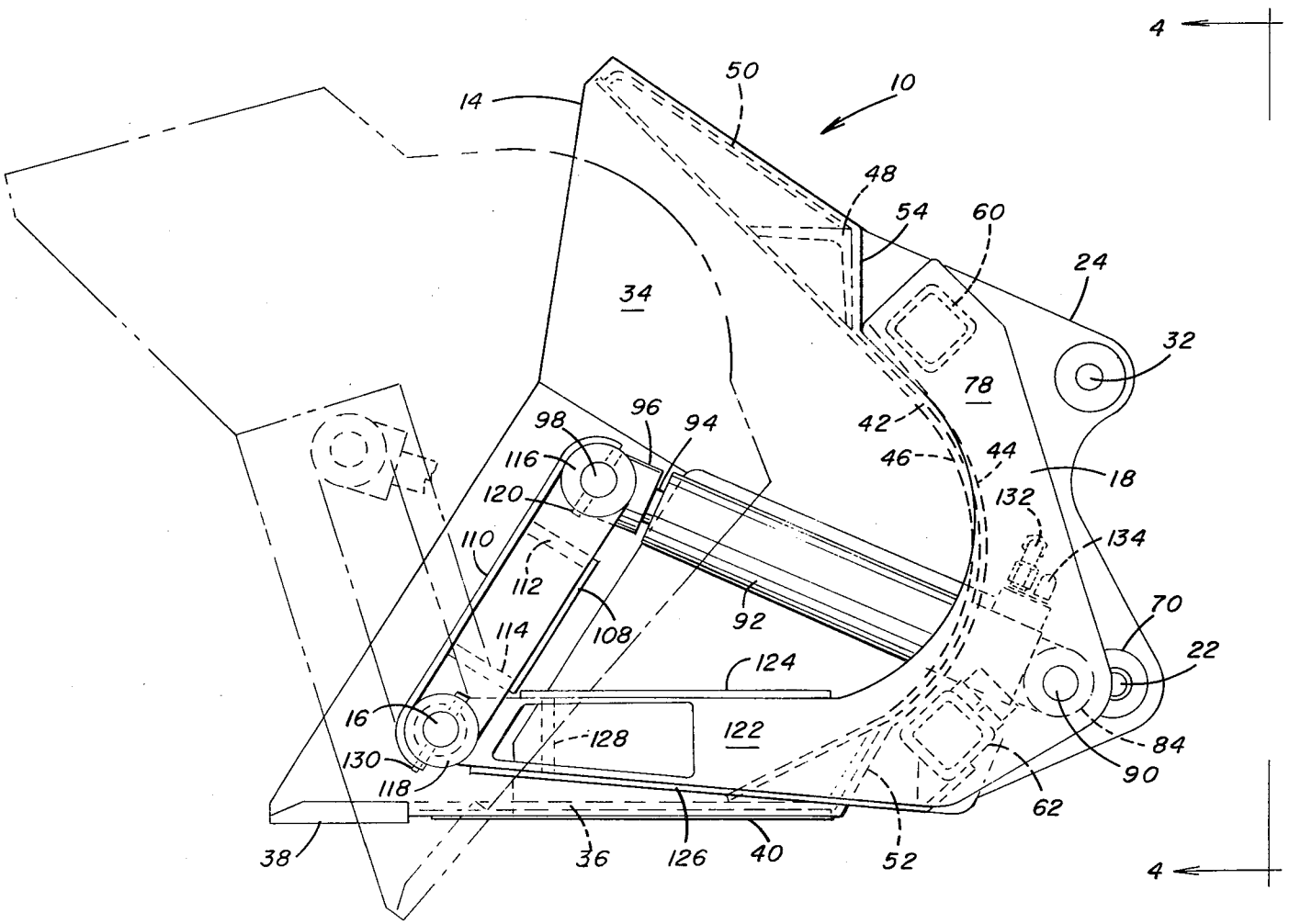
FIG. 3 is an enlarged view in side elevation of the loader bucket assembly, illustrating in phantom the pivotal movement of the bucket portion relative to the carrier portion that is supported by the lift booms of the earth working machine.

The bucket portion 14, as illustrated in greater detail in FIG. 3, includes a pair of laterally spaced, parallel sidewalls 34 which are rigidly secured as by welding to a floor plate 36 that extends between sidewalls 34 to seal the bottom opening therebetween. A cutting edge 38 is disposed along the forward edge of the floor plate 36. A plurality of brace members 40, as illustrated in FIG. 4, are secured to and extend from front to rear of the floor plate 36 and serve to reinforce the bottom surface of the bucket portion 14.

A back plate 42 having an outer surface 44 and an inner surface 46 is securely fastened, as by welding, to the floor plate 36 and sidewalls 34 and extends upwardly in an arcuate path from the floor plate 36 to the top edge of the sidewalls 34. With this arrangement the bucket portion 14 forms an enclosure open to the front for receiving and discharging material. The upper portion of the sidewalls 34 and the back plate 42 are reinforced by an angle brace 48 and a support frame 50 that extends transversely between the sidewalls 34. In a similar arrangement the sidewalls and back plate are reinforced adjacent the floor plate by brace members 52 that extend upwardly from the floor plate 36 to the back plate 42 between the sidewalls 34.

The angle brace 48 and support frame 50 of the bucket portion 14 also serve to support an upwardly extending portion of the sidewalls 34 that includes a vertically extending rearward face 54. The vertical face 54 on the rear of the bucket portion 14 serves as an abutment for the brackets 24 and 26 that are secured to the carrier portion 18 so as to position the bucket portion 14 in a hauling position on the carrier portion 18.

Figure 4:
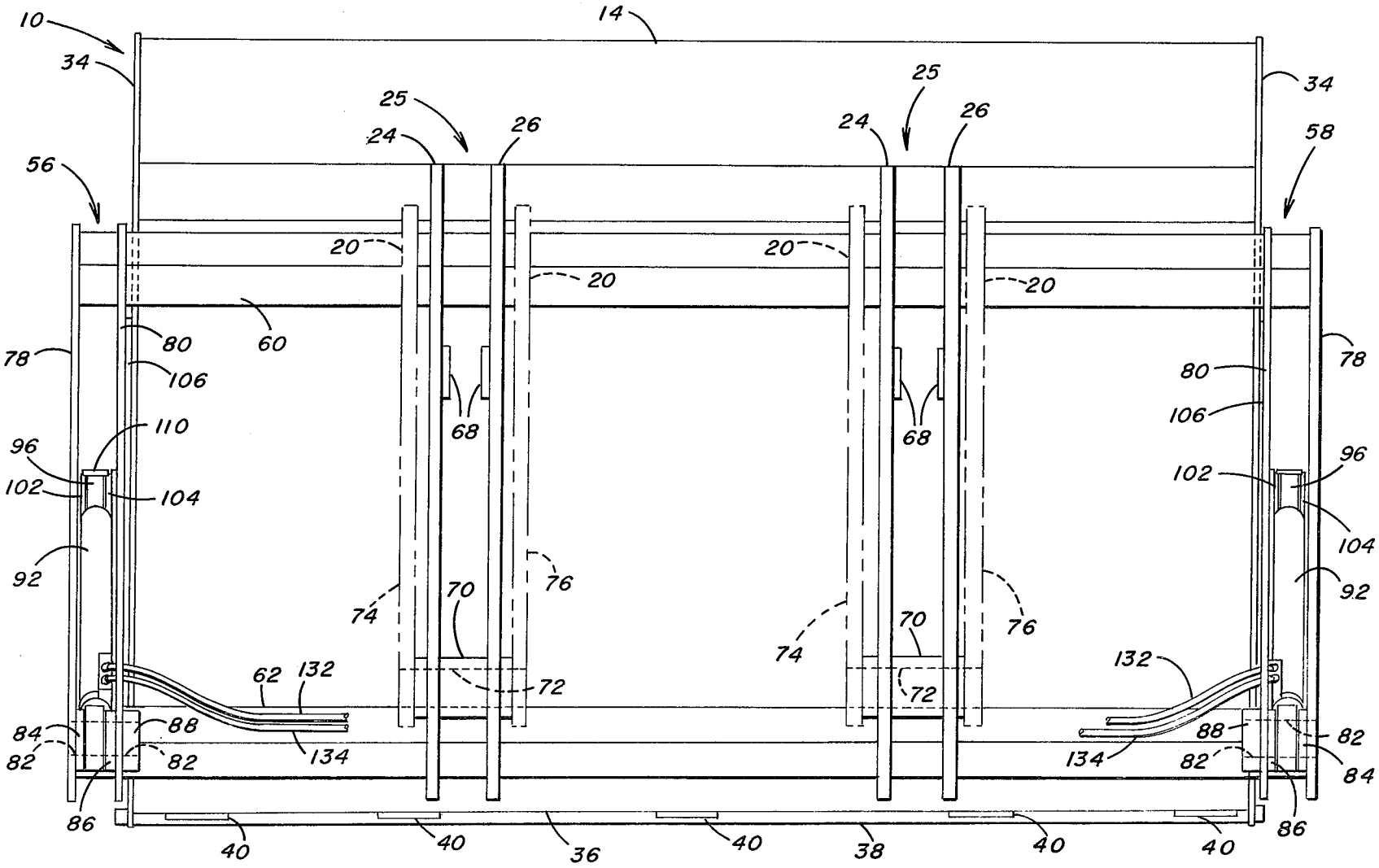
FIG. 4 is a rear elevation taken along line 4—4 of FIG. 1, illustrating the piston cylinder assemblies mounted on the carrier portion and secured to the bucket portion for pivoting the bucket portion relative to the carrier portion which is secured to the machine lift booms illustrated in phantom.

The carrier portion 18, as illustrated in FIGS. 3 and 4, includes arm members generally designated by the numerals 56 and 58 that are positioned laterally outboard of the bucket sidewalls 34. The arm members 56 and 58 are connected and spaced from one another by support members 60 and 62. The bracket assembly 25 is, in turn, secured to and extends rearwardly from the support members 60 and 62. The support members are illustrated in FIGS. 1, 2 and 3 as box beams that extend transversely between the upper and lower portions of the arm members 56 and 58. Each of the brackets 24 and 26 of bracket assembly 25 are secured vertically in spaced relation to the box beams 60 and 62 adjacent the end portions thereof. A cylindrical boss 68 having a bore therethrough is welded to the inboard side of each bracket 24 and 26 so that a pair of bosses are oppositely positioned to receive the pins 32 that extend through the connector end portion of the piston rod 30 of each of the piston cylinder assemblies 28. In this manner the piston cylinder assemblies 28 are connected to the brackets 24 and 26.

At the lower end of each of the bracket pairs 24 and 26 adjacent the box beam 62 is secured a sleeve 70 having a bore 72 extending therethrough. As illustrated in FIGS. 1, 2 and 4, the lift booms 20 include bifurcated end portions 74 and 76 that are positioned laterally and in contact with the sleeves 70. The bifurcated portions 74 and 76 include bores that are aligned with the bores 72 to receive the boom pins 22. In this manner the carrier portion 18 is secured to the lift booms 20.

It will be apparent from the present invention that with this arrangement a bucket portion 14 of a preselected size may be mounted on any conventional earth working machine by selectively positioning the brackets 24 and 26 on the carrier portion to accommodate the connection to the lift booms 20. This provides a versatile loader bucket assembly that is readily adaptable for mounting on any earth working machine by modifying the carrier portion 18 for connection to the lift booms and the tilt piston cylinder assemblies of the particular earth working machine. Thus, with the present invention an enlarged bucket portion may be mounted on an earth working machine normally designed to accommodate a bucket portion of smaller capacity without experiencing a reduction in the maximum vertical height of discharging the contents of the bucket and stability of the machine. This permits installation of a larger bucket assembly on a smaller earth working machine to thereby increase the normal capacity of the machine.

Referring to FIG. 4, the arm members 56 and 58, secured to the opposite ends of the box beams 60 and 62, each include spaced parallel side plates 78 and 80 having at the lower rearward end of the plates aligned bores 82 with bosses 84 welded to plate 78 and bosses 86 and 88 welded to the plates 80. The bosses include bores aligned with bores 82 of plates 78 and 80 for receiving a pin 90 shown in FIGS. 1 and 2 for connecting one end portion of the piston cylinder assembly 92 to the carrier portion 18. Each of the piston cylinder assemblies 92 includes an extensible piston rod 94. As illustrated in greater detail in FIG. 3, the piston rod 94 includes an enlarged end portion 96 having a bore for receiving a pin 98 that extends through an aligned bore in a pivot arm assembly generally designated by the numeral 100 that is rigidly secured to the outboard side of the bucket sidewalls 34. In this manner the assemblies 92 are connected to the bucket portion 14.

The pivot arm assembly 100 is mounted to each of the bucket sidewalls 34 and includes a pair of parallel spaced plates 102 and 104 illustrated in FIG. 4 with plate 104 suitably welded to plate 106 that is secured to the outer surface of sidewall 34. The plates 102 and 104 are joined together by plates 108 and 110 with each plate having an arcuate end portion as illustrated in FIG. 3 that overlies the end portions of plates 102 and 104. The plates 108 and 110 are also connected by parallel spaced plates 112 and 114. Secured to the ends of plate 102 are bosses 116 and 118 having bores aligned with bores extending through plate members 102 and 104. With this arrangement the pin 98 extends through the aligned bores of boss 116, plates 102 and 104, and the end portion 96 of piston rod 94 to form a pivotal axis about which the piston cylinder assembly 92 is pivotally connected to the pivot arm assembly 100. A keeper pin 120 extends through the bores 116 to retain the pin 98 within the aligned bores.

At the lower end portion of the pivot arm assembly 100 each of the plates 102 and 104 is connected to pairs of arm members 122 that extend forwardly from the bottom of side plates 78 and 80. The arm members 122 taper inwardly in spaced relation from the widest point at the base of the side plates 78 and 80 to the end portion of the arm members. Plates 124 and 126 are secured, as by welding, to the upper and lower surfaces of the arm members 122. The plates 124 and 126 are supported by a transversely extending plate 128. The arm members 122 taper inwardly at the end portions and are maintained in spaced relation to be positioned between the plates 102 and 104 of the pivot arm assembly 100. The arms 122 include bores aligned with the bores of plates 102 and 104 for receiving the pivot pin 16. A keeper pin 130 extends through the boss 118 and pin 16 to retain the pin 16 within the aligned bores and provide a pivotal connection between the bucket portion 14 and the carrier portion 18.

With the bucket portion 14 pivotally connected to the arm members 122 of the carrier portion 18, the bucket portion 14 is movable relative to the carrier portion 18 by operation of the piston cylinder assemblies 92. Upon actuation of the piston cylinder assemblies 92 by the flow of fluid under pressure through conduits 132 and 134 the bucket portion 14 is pivotal in an arcuate path toward and away from the carrier portion 18 about a pivotal axis extending through each of pins 16. Additional pivotal or tilting movement of the bucket and carrier portions combined is accomplished by operation of the tilt piston cylinder assemblies 28. Thus, complete discharge of the bucket portion 14 is carried out by initially tilting the carrier portion in a forward direction and then forwardly pivoting the bucket portion relative to the carrier portion. This arrangement assures complete discharge of the bucket portion at the maximum dump height attainable.

The combination of the carrier and bucket portions as above described permits the installation of an enlarged loader bucket assembly on an earth working machine normally designed to support a smaller loader bucket. Consequently, earth working machines may now be equipped with loader buckets larger than normally available without experiencing a reduction in the dump height and reduced stability of the machine. To this end when the lift booms 20 raise the assembly 10 to a preselected discharging height and particularly to the maximum height attainable, the carrier portion 18 is first tilted forwardly relative to the lift booms and thereafter the bucket portion 14 is pivoted forwardly about pins 16 on the carrier portion. It is the relative pivotal movement of the bucket portion on the carrier portion that assures complete discharge of the bucket portion at the maximum dump height to which the carrier portion can be raised. Furthermore, with the carrier maintained in a rearward position as the bucket portion is forwardly pivoted, the center of gravity of the loader bucket assembly is maintained rearwardly. This arrangement stabilizes the earth working machine to permit discharging the bucket portion at the maximum dump height.

It will be further apparent from the present invention that by pivotally supporting the bucket portion on the carrier portion the bucket portion is movable through an additional pivotal angle not otherwise obtainable when the bucket portion and the carrier portion are constructed as a single unit. It is this feature that permits an enlarged loader bucket assembly 10 to be mounted on smaller capacity earth working machines without reducing the dump height and machine stability. The pivotal connection between the carrier portion and the bucket portion expands the angle through which the bucket portion may be pivoted to discharge the contents thereof particularly for oversized loader bucket assemblies at the maximum discharging height.

Figure 5:
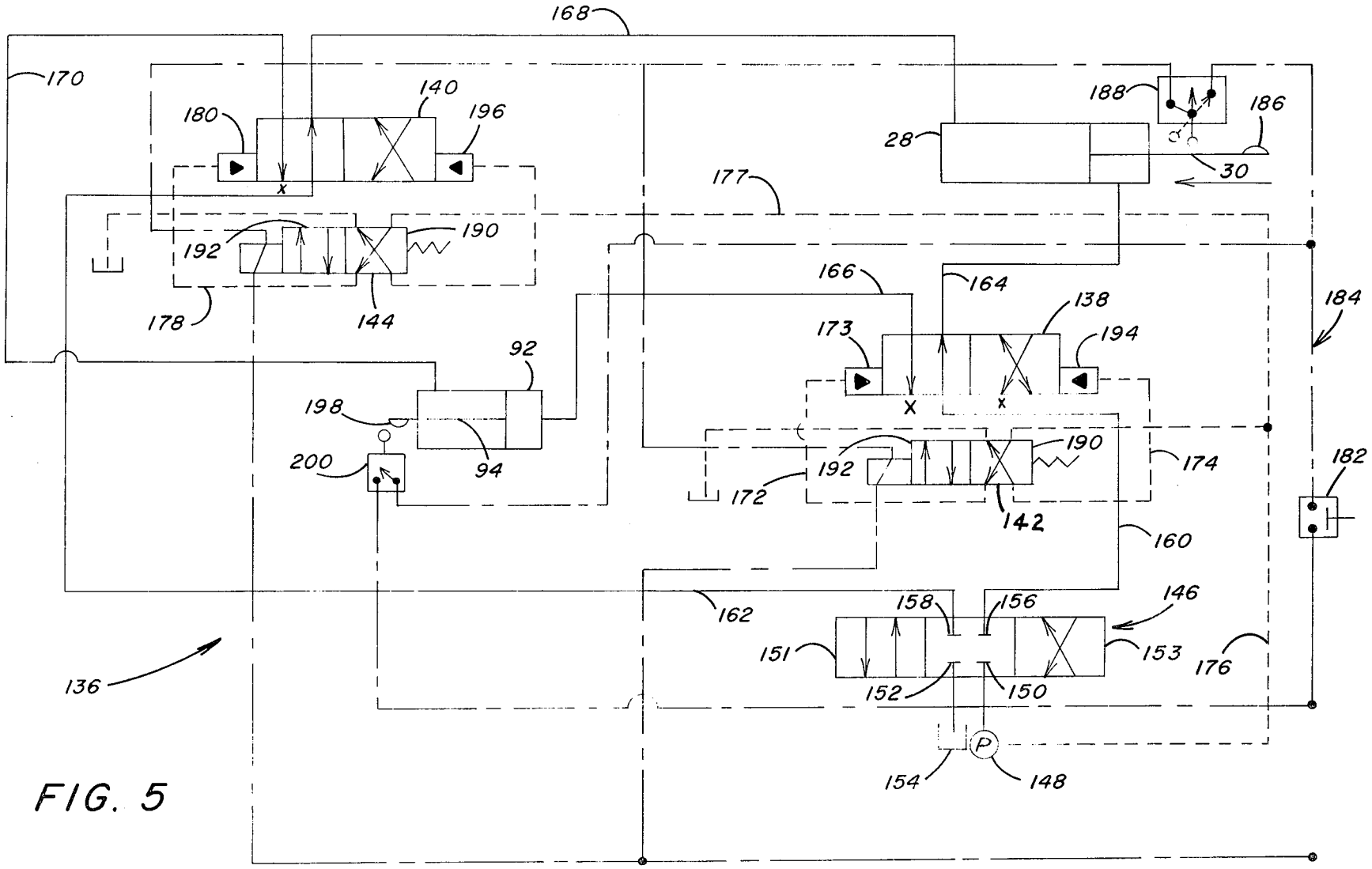
FIG. 5 is a schematic of the control circuitry for automatically operating the piston cylinder assemblies to complete a loading and discharging cycle of the loader bucket assembly.

With reference to FIG. 5 there is illustrated a control circuit generally designated by the numeral 136 by which the pairs of piston cylinder assemblies 28 and 92 (only one of each are illustrated in FIG. 5) are automatically operated to carry out the discharging cycle of the loader bucket assembly 10 when the assembly is elevated to a dump position. The piston cylinder assemblies 28 and 92 are controlled by operation of spool valves 138 and 140 which are, in turn, actuated by solenoid valves 142 and 144 respectively. A four-way control valve generally designated by the numeral 146 controls the flow of pressurized fluid from a pump 148 to and from the cylinders 28 and 92. The control valve 146 includes a pair of inlets 150 and 152 that are connected by conduits to the pump 148 and a tank 154. The conduits for transmitting pressurized fluid throughout the control circuit 136 are indicated by the solid lines in FIG. 5. Outlets 156 and 158 of the control valve 146 are connected by conduits 160 and 162 to valves 138 and 140 respectively. Valve 138 includes outlets that are connected by conduits 164 and 166 to the rod side of cylinder 28 and to the piston side of cylinder 92, respectively. The valve 140 is, in turn, connected by conduits 168 and 170 to the piston side of cylinder 28 and to the rod side of cylinder 92 respectively.

The solenoid valve 142 associated with valve 138 is connected thereto by pilot lines 172 and 174. The pilot lines are indicated by - - - lines in FIG. 5. The solenoid valve 142 is spring biased in a first position so that the pilot pressure from line 176 is directed through solenoid valve 142 and therefrom through line 172 to a pilot control inlet 173 of valve 138. Thus, with solenoid valve 142 in the biased position illustrated in FIG. 5, fluid under pressure flows from valve 138 through conduit 164 to the rod side of cylinder 28. In a similar arrangement solenoid valve 144 is biased in a first position so that pilot pressure from pump 148 is conducted through pilot lines 176 and 177 and valve 144 to pilot line 178 to a pilot control inlet 180 of valve 140. Valve 140 is normally positioned for conducting fluid to and from the piston side of cylinder 28.

To initiate the discharging cycle of the loader bucket assembly 10, the lift booms 20 are raised to a preselected position above ground for discharging the contents of the bucket portion 14. With the assembly 10 elevated by the lift booms 20, electrical switch 182 of an electrical control circuit, generally designated by the numeral 184 and indicated by - : - lines in FIG. 5, is manually closed. The control valve 146 is moved to position 151. In position 151 fluid under pressure is directed from valve inlet 150 to valve outlet 156 and through conduit 160 to valve 138. With valve 138 positioned as shown in FIG. 5, fluid is directed from valve 138 through conduit 164 to the rod side of each of the tilt piston cylinder assemblies 28. In this manner, the assemblies 28 are actuated to effect forward pivoting of the carrier and bucket on the boom members.

As illustrated in FIG. 5, the piston rod of piston cylinder assembly 28 includes a cam member 186 which strikes electrical switch 188 as the rod retracts to pivot the electrical switch to the position illustrated in phantom in FIG. 5. The circuit connecting solenoid valves 142 and 144 to a power source (not shown) is thus closed to energize each of the solenoid valves 142 and 144 and move each valve from position 190 to position 192. In position 192, pilot pressure from pilot line 176 is directed through pilot line 174 to pilot control inlet 194 of valve 138. Fluid to inlet 194 moves valve 138 to a position where fluid is diverted from hydraulic line 164 to hydraulic line 166 and the piston side of cylinder 92. The rod of cylinder 92 is extended to effect forward pivoting of the bucket portion 14 on the carrier portion 18 and complete the dumping cycle. This operation is automatically carried out by control of the valve 146 without the need to manually actuate an additional control once the tilting of the carrier portion 18 is accomplished by assemblies 28. Extension of rod 92 moves a cam member 198 into contact with an electrical switch 200 to further close the electrical circuit between solenoid valves 142 and 144 and the power source. With switch 200 closed, the solenoid valves 142 and 144 remain energized in the event switch 182 should be inadvertently opened.

Solenoid valve 144 is also actuated to move the valve to position 192 so that pilot pressure is directed from the solenoid valve 144 to pilot control inlet 196 of valve 140. The valve 140 is moved to a closed position. In a normally open position, valve 140 directs fluid from conduit 168 to conduit 162 and the tank 154. However, upon actuation of valve 138, fluid is directed from conduit 160 through conduit 166 to the piston side of cylinder 92. Rod 94 is extended to close the switch 200 as above described. Thus, with the above described arrangement, once electrical switch 182 is initially closed, the discharging cycle is automatically commenced and cannot be interrupted by opening electrical switch 182.

The loader bucket assembly 10 having been raised to a preselected vertical height is initially dumped by actuation of the piston cylinder assemblies 28. In accordance with the present invention the piston cylinder assemblies 28 may be actuated either by extending or retracting the piston rod 30 to forwardly tilt the carrier portion on the lift booms 20. Thereafter, the dumping cycle is completed by actuation of the piston cylinder assemblies 92 to forwardly pivot the bucket portion 14 on the carrier portion 18.

Accordingly, to return the bucket portion 14 and carrier portion 18 to the initial position, the control valve 146 is moved from position 151 to position 153 so that pressurized fluid is directed from the pump 148 through conduit 162 to valve 140 and therefrom to conduit 170. Fluid from conduit 170 is introduced into the rod side of cylinder 92. The piston rod 94 is retracted into the cylinder to open electrical switch 200. Fluid from piston cylinder assembly 92 is directed through conduit 166 to valve 138 which is positioned to provide flow from conduit 166 to conduit 160. With this arrangement, fluid from cylinder 92 is directed back through the control valve 146 to tank 154.

Once electrical switch 200 is opened, switch 182 may then be opened to deenergize the solenoid valves 142 and 144. In this manner solenoid valve 144 is returned to position 190, and pilot pressure is directed to pilot inlet control 180 of valve 140 so that fluid is transmitted from pump 148 through control valve 146 and conduit 162 to valve 140 and therefrom to conduit 168. Fluid is thus directed to the piston side of cylinder 28 to extend the piston rod 30 and move the cam 186 out of contact with switch 188 to open the switch and electrical control circuit 184 and deenergize the solenoid valves 142 and 144.

With the solenoid valves deenergized, hydraulic fluid is directed from the piston cylinder assembly 28 through conduit 164, valve 138, conduit 160 and the control valve 146 to tank 154. Thus, the piston cylinder assemblies 92 are operated to return the bucket portion 14 to the initial hauling position on the carrier portion, as illustrated in FIG. 1 and the piston cylinder assemblies 28 are sequentially actuated in the above described manner to return the carrier portion 18 to its initial hauling position as illustrated in FIG. 1. Lowering the tilt booms 20 completes the cycle.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A loader bucket assembly for an earth working machine comprising, a bucket portion having a back plate engaged to a pair of spaced parallel sidewalls and a floor plate to form an open forward portion for receiving and discharging materials, a carrier portion positioned rearwardly of said bucket portion and having a pair of spaced parallel arm members positioned outboard of said bucket sidewalls, pivot means secured to said bucket sidewalls for connecting said carrier arm members to said bucket sidewalls to permit pivotal movement of said bucket portion through an arcuate path toward and away from said carrier portion, first actuator means connected to said carrier portion for forwardly pivoting said carrier portion and said bucket portion to a first position for discharging the contents of said bucket portion, second actuator means mounted on said carrier portion and connected to said pivot means for moving said bucket portion from said first position to a second position relative to said carrier portion, control means for actuating said first actuator means to pivotally move said carrier portion and said bucket portion to said first position, and said control means being further operable to automatically actuate said second actuator means after actuation of said first actuator means to forwardly pivot said bucket portion on said carrier portion to complete the discharge of the contents of said bucket portion.

2. A loader bucket assembly for an earth working machine as set forth in claim 1 which includes, a plurality of support members secured to and extending between said carrier arm members to maintain said carrier arm members in spaced relation, a bracket assembly secured to and extending rearwardly from said support members, said bracket assembly being adapted for pivotal connection to the earth working machine, and said bracket assembly being positioned relative to said bucket back plate to support said bucket portion on said carrier portion in a materials hauling position.

3. A loader bucket assembly for an earth working machine as set forth in claim 2 which includes, said actuator means connected to said bracket assembly and being operable upon actuation to pivotally move said carrier portion together with said bucket portion to said first position to facilitate the discharge of material from said bucket portion.

4. A loader bucket assembly for an earth working machine as set forth in claim 1 which includes, a pivotal connection between said carrier arm members and said pivot means of said bucket portion, and said bucket portion being arranged upon actuation of said second actuator means to pivot about said pivotal connection relative to said carrier portion through a forward arcuate path to said second position.

5. A loader bucket assembly as set forth in claim 4 in which said pivotal connection includes, a pin member connecting each of said carrier arm members to said pivot means of said bucket portion, said pin member forming a pivotal axis for said bucket portion on said carrier portion, and said pivotal axis extending through the forward end portion of said carrier arm members and the lower portion of said bucket portion for movement of said bucket portion toward and away from said carrier portion.

6. A loader bucket assembly for an earth working machine as set forth in claim 1 in which said pivot means includes, a pivot arm assembly rigidly secured to said sidewalls of said bucket portion, said pivot arm assembly having a lower end portion positioned adjacent the forward end portion of each of said carrier arm members, a first pivotal axis passing through the lower end portion of said pivot arm assembly and the forward end portion of each of said carrier arm members, and said second actuator means being connected to said pivot arm assembly such that actuation of said second actuator means moves said bucket portion in a forward arcuate path about said first pivotal axis.

7. A loader bucket assembly for an earth working machine as set forth in claim 6 which includes, said second actuator means having an extensible portion pivotally connected to the upper end portion of said pivot arm assembly, a second pivotal axis passing through the upper end portion of said pivot arm assembly and said second actuator means extensible portion, and said second pivotal axis movable with said bucket portion upon actuation of said second actuator means toward and away from said carrier portion as said bucket pivots about said first pivotal axis.

8. A loader bucket assembly as set forth in claim 1 in which said control means includes, a control valve for controlling the flow of fluid under pressure between said first and second actuator means and a source of fluid respectively, valve means associated with said first and second actuator means and connected to said control valve for directing the flow of pressurized fluid from said control valve to said first and second actuator means respectively, a hydraulic circuit connecting said valve means with said first and second actuator means, and said valve means being operable to initially direct fluid to said first actuator means to forwardly pivot said carrier portion and said bucket portion and thereafter direct fluid to said second actuator means to forwardly pivot said bucket portion relative to said carrier portion.

9. A loader bucket assembly as set forth in claim 8 which includes, a solenoid valve for controlling operation of said valve means, an electrical control circuit for supplying electrical power to said solenoid valve, a first switch provided in said electrical control circuit for normally maintaining an open circuit condition, and said first actuator means being operable to close said first switch and supply electrical power to said solenoid valve to actuate said valve means and direct fluid to said second actuator means for actuation thereof to move said bucket portion to said second position.

10. A loader bucket assembly as set forth in claim 9 which includes, a second switch provided in said electrical control circuit and normally maintained in an open circuit condition, and said second switch being arranged to close upon actuation of said second actuator means to maintain said electrical control circuit in a closed condition to actuate said solenoid valve and said valve means in the event said first switch is opened.

* * * * *